United States Patent [19]

Johnson

[11] 4,341,164

[45] Jul. 27, 1982

[54] FOLDING CAMP TABLE

[75] Inventor: Johnny L. Johnson, San Antonio, Tex.

[73] Assignee: Charles H. Ruble, San Antonio, Tex.

[21] Appl. No.: 159,395

[22] Filed: Jun. 13, 1980

[51] Int. Cl.[3] ..... A47B 1/06; A47B 3/04

[52] U.S. Cl. ..... 108/67; 108/127; 108/157; 108/115

[58] Field of Search ..... 108/155, 157, 159, 129, 108/34, 67, 115, 112

[56] References Cited

U.S. PATENT DOCUMENTS

| | | | |
|---|---|---|---|
| 557,045 | 3/1896 | Baxter | 108/34 X |
| 1,072,550 | 9/1913 | Wilson | 108/157 |
| 1,126,611 | 1/1915 | Wright | 108/67 |
| 1,877,654 | 9/1932 | Flink et al. | 108/129 |
| 1,997,182 | 4/1935 | Peck | 108/159 |
| 2,071,928 | 2/1937 | Golden | 108/129 |
| 2,535,920 | 12/1950 | Hart | 108/157 |
| 2,862,777 | 12/1958 | Paige | 108/34 |
| 3,387,572 | 6/1968 | Ulrich | 108/34 |
| 3,884,159 | 5/1975 | Faria | 108/67 |
| 4,026,219 | 5/1977 | Shupe et al. | 108/157 |

FOREIGN PATENT DOCUMENTS

| | | | |
|---|---|---|---|
| 1504468 | 10/1967 | France | 108/129 |

*Primary Examiner*—Francis K. Zugel

*Attorney, Agent, or Firm*—Gunn, Lee & Jackson

[57] ABSTRACT

A folding camp table comprising a collapsible lightweight frame and a compactable table surface. The frame comprises a pair of spaced apart side rails, a pair of spaced apart end rails perpendicular to the side rails, two pairs of spaced apart legs, removable cross bars retained by cross bar retainers and connecting and perpendicular to each leg in each pair of legs, locking supports having one end attached to the side rail and the opposite end attached to a leg located normal to the side rail, hinges midway on each end rail and latches midway on each side rail. The table surface comprises a flexible, easily compacted material having support members located along the length of the table surface and extending the width of the table surface. The invention folding camp table is designed so as to be lightweight and easily compacted into a unit that can be transported in a minimal amount of space yet have considerable stability and structural integrity.

11 Claims, 17 Drawing Figures

FOLDING CAMP TABLE

BACKGROUND OF THE INVENTION

This invention relates to tables used in camping. The invention folding camp table comprises a lightweight easily collapsible table frame and a removable table surface. The table frame is constructed so as to be readily folded into a compact unit occupying a minimal amount of space. The separate removable table surface is likewise readily folded or compacted into a unit taking up a minimum amount of space. The lightweight easily transported invention table can be used by campers, picnickers or backyard cookers since in its folded configuration the table is easily transported by even one person and occupies minimal space. When extended into its operational configuration, the table is sturdy and stable enough to bear considerable weight and still be large enough to accomodate large amounts of food and/or equipment.

BRIEF DESCRIPTION OF THE PRIOR ART

Folding camp tables are well-known in the art and numerous versions are available in the marketplace. Some of these tables are a unitary body, that is the table surface and the frame are permanently joined. In a table of such construction, a hinge is usually located in the midsection of the table and extends the width of the table. When the table is folded, the overall size of the table is merely reduced by half. The legs of this type of camp table may be folded by various mechanisms into the table and come to rest parallel to the sides of the table. Alternatively, the legs may be connected together to form pairs, each pair being folded into and parallel to the table surface. Usually the tables as above described are heavy and cumbersome and are sometimes so large even when folded to be impossible to transport.

At a time when automobiles and other vehicles are being reduced in size and weight in order to decrease operating costs, compactness, efficient utilization of space and weight are of prime importance. The invention folding camp table provides a lightweight, compact unit having minimal space requirements. The invention table can be easily carried and erected by one person yet still affords a user with a sturdy and stable table having a large surface area.

SUMMARY OF THE INVENTION

It is an object of the present invention to provide a folding lightweight camp table comprising a collapsible table frame and a removable compactable table surface. The table frame comprises a pair of spaced apart side rails, a pair of spaced apart end rails perpendicular to the side rails, two pairs of spaced apart legs, removable cross bars connecting and perpendicular to each leg in each pair of legs, locking supports having one end attached to the side rail and the opposite end attached to a leg located normal to the side rail, hinges midway on each end rail, and latches midway on each side rail.

To fold the invention camp table, the table surface is first lifted from the table frame and rolled into a compact form. The latches on the side rails are then unhooked and the ends of the table are brought upward to touch each other. The cross bars located between each pair of legs is then removed. The locking supports are subsequently disengaged by pressing a lockout button or pin. Upon folding the locking support, each leg is folded up and fitted over and around the side rail thereby forming a box-like totally enclosed unit. Hinges located on each end rail are then relaxed so as to allow the end rails to slide over and around the box-like enclosed unit formed by the side rails and the legs. Finally the table frame is collapsed into its compact easily transported size.

The removable compactable table surface comprises a flexible, easily compacted material having support members located along the length of the table surface and extending the width of the table surface. The support members are positioned on the bottom of the table surface, the ends of the support members abut the interior side of the side rails of the table frame. The support members are made of materials that are flexible so as to enable the table surface to be folded and compacted yet are sturdy and strong enough to support the table surface and any matter placed on the table surface.

The collapsed table frame and rolled table surface together form the invention lightweight folding camp table.

DESCRIPTION OF THE PREFERRED EMBODIMENT

Figure 1:
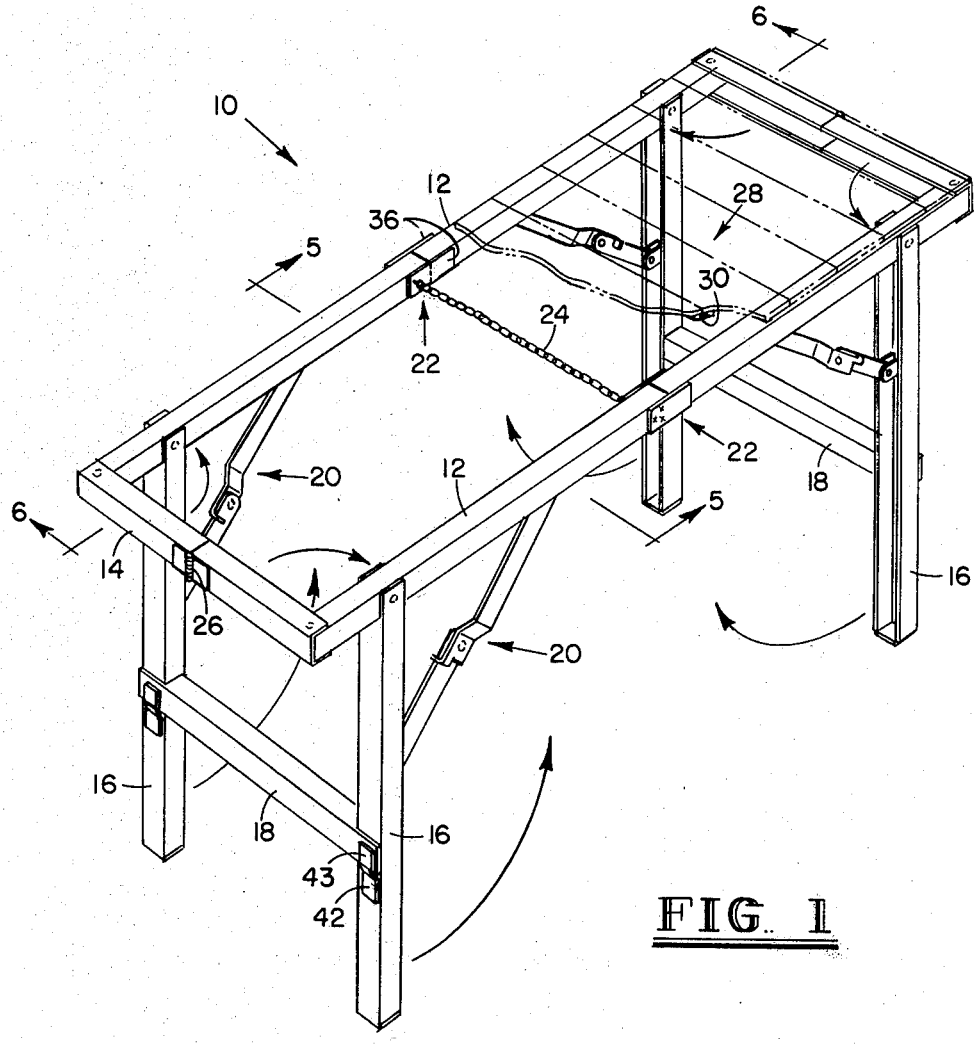
FIG. 1 is a perspective view of the frame of the invention folding camp table.

For a detailed description of the invention, reference is made to the attached drawings wherein the invention is illustrated and will be described. Identical reference characters will be utilized to refer to identical or equivalent components throughout the various views and the following description.

Figure 2:
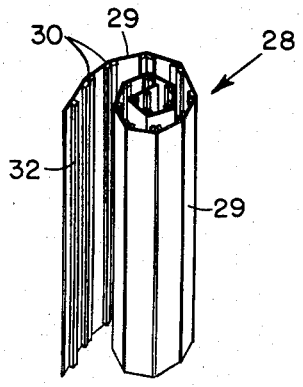
FIG. 2 is a view of a partially compacted table surface of the invention folding camp table.

Referring to FIGS. 1 and 2, the invention folding camp table (with the table surface removed) is shown in its fully erected position. The invention comprises a folding camp table frame 10 and table surface 28. The frame 10 is composed of a pair of spaced apart side rails 12, a pair of spaced apart end rails 14 at right angles to the side rails 12, the side rails and end rails forming a rectangle. Two pairs of spaced apart legs 16 are positioned perpendicular to the rectangle formed by the end rails 14 and side rails 12. Connecting and perpendicular to each leg 16 in each pair of legs and retained by cross bar retainer 42 are removable cross bars 18. Locking supports 20 have one end attached to the side rail 12 and the opposite end attached to a leg 16. Latches 22 are located midway on each side rail 12. Chain 24 extends the width of table frame 10 and is attached to each side rail 12 at the midpoint of each side rail. Hinges 26 are located midway of each end rail 14. Table surface 28 when unfolded extends the length and width of table frame 10, the bottom of table surface 28 resting on the top surface of the side rails 12 and end rails 14. Table surface supports 30 and 32 (to be described in detail later) located on the bottom of table surface 28 extend the width of the table surface 28 with each end of the support abutting the interior portion of side rails 12. The table surface supports 30 and 32 are slightly inset from the outside edge of table surface 28 (see FIG. 32) so as to enable the bottom of table surface 28 to rest flush on the table frame side rails 12 and end rails 14. Flexible table surface supports 30 in addition to supporting table surface 28 also provide means of flexing the table surface to enable the table surface to be rolled and compacted as shown in FIG. 2.

As shown in FIG. 1, the invention camp table frame 10 is constructed of aluminum U-shaped tubing for the side rails 12, end rails 14, and legs 16. Cross bars 18 are formed from L-shaped aluminum tubing. Locking supports 20, latches 22 and hinges 26 are also constructed of aluminum material. Although the invention camp table will be discussed as mainly constructed of aluminum and other lightweight materials, the invention is not limited to these materials. One of the desired properties of the invention camp table is its lightness in weight both in the frame 10 and table surface 28 so therefore aluminum and other lightweight materials are desirable.

Figure 3A:
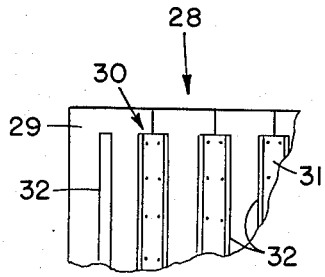
FIGS. 3*a* and 3*b* are bottom and top planar views, respectively, of the table surface shown in FIG. 2.
Figure 3B:
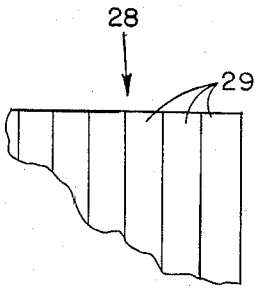
Figure 4B:
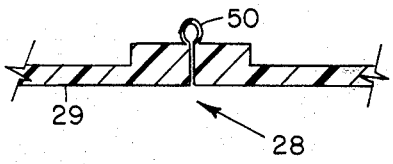
FIGS. 4*a*, 4*b* and 4*c* are side views of various configurations of table surfaces similar to the table surface of FIG. 2.
Figure 4A:
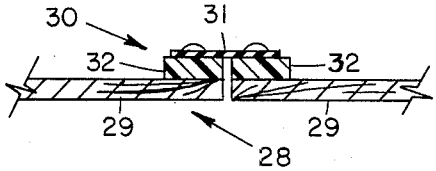

The supporting means for the table surface 28 are shown in greater detail in FIGS. 3 and 4. In FIG. 3, a top and bottom view of table surface 28 is shown wherein table surface slats 29 abut each other to provide a continuous surface. Support means and slat connecting means are shown in detail in the bottom view of FIG. 3 and FIG. 4*a*. Rigid table supports 32 are located on the last slat 29 of each end of the table surface 28 to provide support to the table structure. Flexible table surface supports 30 provide both support means and means to connect slats 29. The connecting means is accomplished by attaching a flexible connector 31, such as rubber or vinyl, to each rigid table surface support 32, the support 32 being secured to slat 29 by any number of well-known means, such as nailing or gluing. The flexible connector 31 attached by conventional means to the rigid table surface supports 29 forms a type of hinge allowing the table surface 29 to be rolled up into a compact unit as illustrated in FIG. 2.

The table surface 28 shown in FIGS. 2, 3 and 4*a* is composed of slats of rigid material, such as a Masonite® or pressed board although any material that would be rigid enough to provide support for table frame 10 and support weight placed on the table surface would be suitable.

Figure 4C:
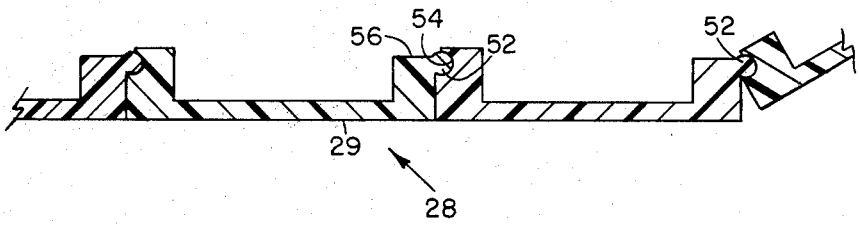

Alternative table surfaces are shown in FIGS. 4*b* and 4*c*. In FIG. 4*b*, table surface 28 having a flexible/rigid support 50 is shown. In this embodiment, both the table surface 28 and the support 50 may be made of the same material, such as moldable plastic, by a process such as profile extrusion molding in contrast to FIG. 4*a* wherein three different materials are used to construct the supports, Masonite® for the table slats 29, wood strips for the rigid table surface supports 32, and flexible material for the connector 31. In addition to needing various materials for the embodiment of FIG. 4*a*, additional labor is involved to assemble the supports shown in FIG. 4*a*.

Yet another embodiment of the table surface is illustrated in FIG. 4*c* wherein again the table surface 28 and the supports 54 and 56 may be one material, such as moldable plastic, formed by a process such as injection molding. In FIG. 4*c*, on opposing sides of the slat 29 are located ball connectors 52 and socket connector 54 which fit together to form a ball/socket joint 56. This type of joint is flexible enough to allow the table surface 28 to be rolled into a compact form, yet is rigid enough to provide support for table surface 28 when it is placed on top of table frame 10. All the embodiments of FIGS. 4*a*, 4*b* and 4*c* function in the same manner to provide a table surface for the table frame 10, the surface being flexible to allow it to be shaped into a compact, easily carried form yet rigid enough to support weight placed on the table surface.

Figure 5:
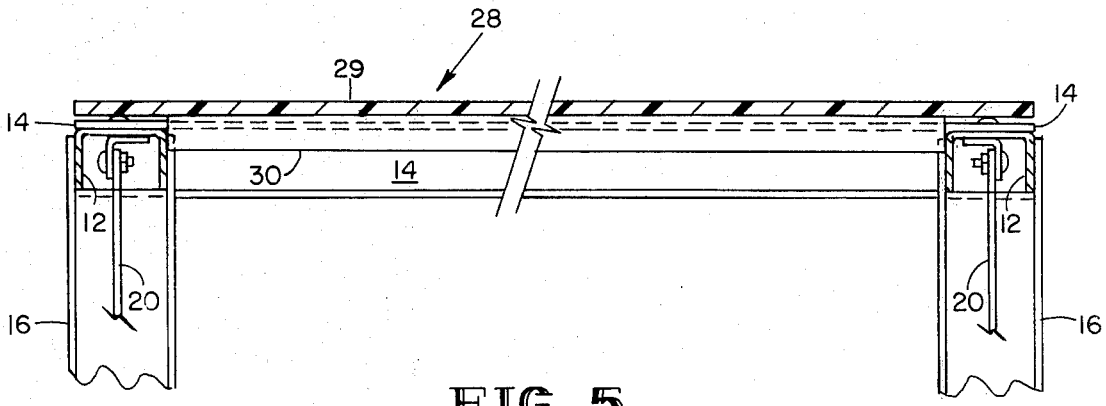
FIG. 5 is a partial cross-sectional view across the width of the invention table frame taken along lines 5—5 of FIG. 1.

FIG. 5 shows a cross-sectional view taken along lines 5—5 of the table frame 10 in FIG. 1. Legs 16 fit in close tolerance to side rail 12. Side rails 12 are 1 1/16" U-shaped aluminum tubing as are legs 16 and end rails 14. The top edge of legs 16 are flush with the top of side rail 12 and are set back from the point of engagement of the end rail with side rail 12 to allow for rotation of leg 16 when folding the table frame into its compact unit.

Figure 6:
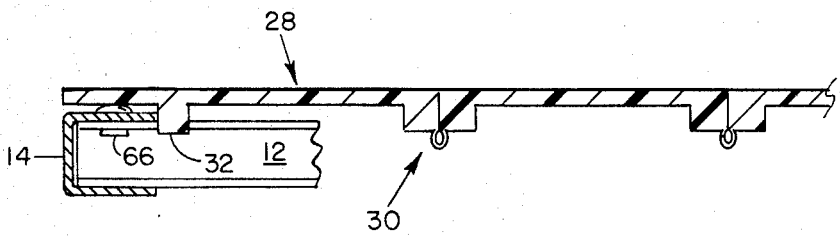
FIG. 6 is a partial cross-sectional view of the end of the invention table frame taken along lines 6—6 of FIG. 1.

FIG. 6 is a cross-sectional view of the end of table frame 10 taken along lines 6—6 of FIG. 1 with table surface 28 being in place. End rail 14 formed by 1 1/16" U-shaped aluminum tubing the same as for side rails 12 and legs 16 receives side rails 12. Table surface 28 having rigid table surface supports 32 and flexible table surface supports 30 rests on end rail 14. Rivet 66 connects end rail 14 to side rail 12 and allows the end rail to pivot and slide over side rail 12 when table frame 10 is collapsed.

Figure 7:
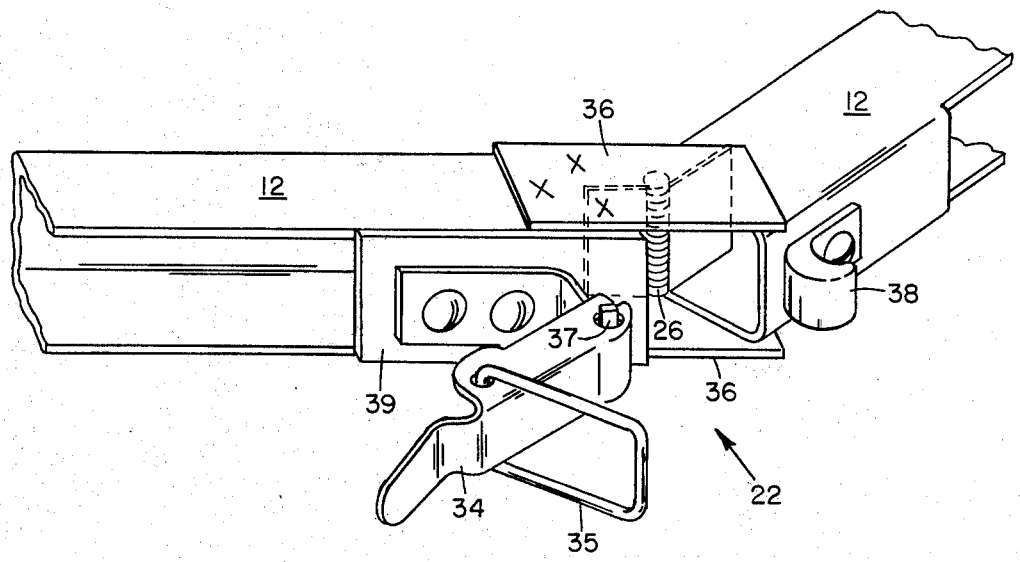
FIG. 7 is an enlarged view of the center of the side rail of the invention table having a hinge.

The latch 22 located midway on each side rail 12 is illustrated in FIG. 7. The latch mechanism is well-known in the art and will not be discussed in great detail except to demonstrate how it is used in the invention. Located on the bottom side of side rail 12, the latch 22 comprising buckle 34 having a loop 35 pivots on pin 37 enough to allow loop 35 to be received in buckle hook 38. Buckle 34 is then pressed downward to its original position on buckle plate 39 thereby securing side rail 12 into a rigid straight line configuration. Braces 36 located on either side of side rail 12 provide attachment means of latch 22 to side rail 12. Hinge 26 enables side rail 12 to be folded after buckle loop 35 has been disengaged from buckle hook 38.

Figure 8:
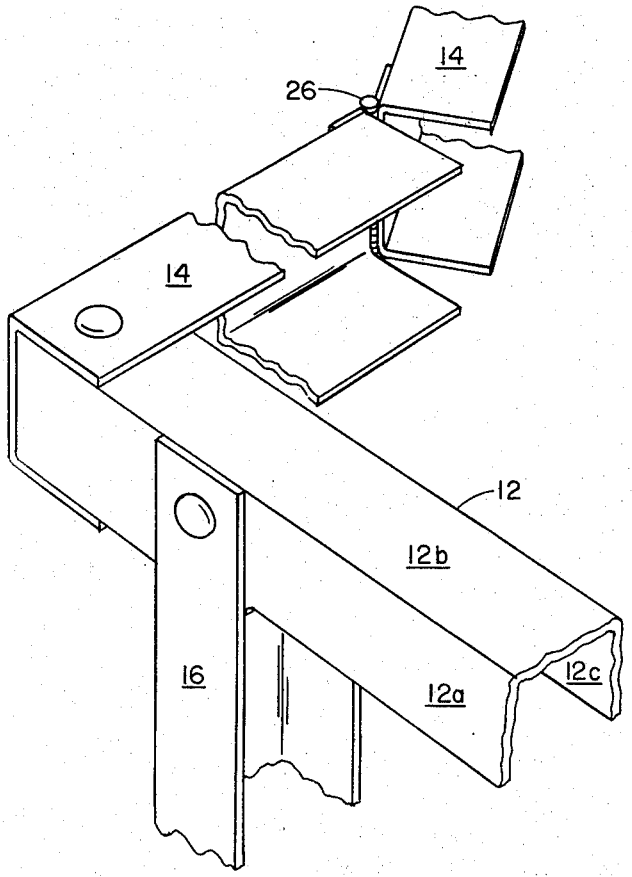
FIG. 8 is a partially cut-away view of a corner of the invention table.

FIG. 8 shows a detailed partially cut-away view of a corner of the invention table. This figure clearly illustrates the uniqueness of the invention being folded upon itself. Side rails 12, end rails 14, and legs 16 are all constructed of 1 1/16" U-shaped aluminum tubing. However, in order to receive both leg 16 and end rail 14, side rail 12 has been milled down to a 1" width from the pivot point of one leg to the pivot point of the other leg. Hence, side rail 12 between the legs 16 is 1" on side 12*a*, 1 1/16" on side 12*b*, and 1" on side 12*c*. In other words, the channel of side rail 12 is 1 1/16" wide, but the walls of the channel are only 1" wide. The channel of end rail 14 is likewise 1 1/16" wide, but walls 14*a* and 14*c* have also been milled to 1" so as to fit over and flush with leg 16 and produce a smooth precise unit when end rail 14 is folded onto side rail 12 having already folded thereon leg 16.

Figure 9:
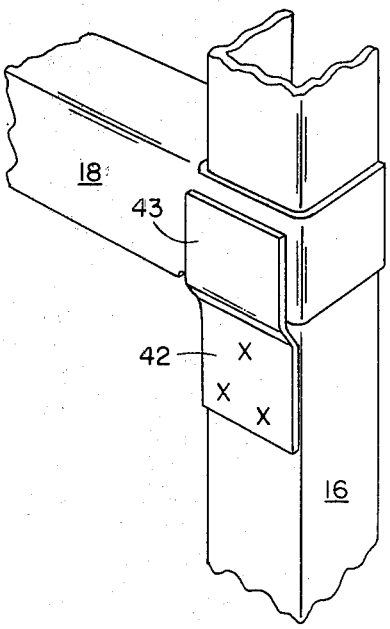
FIG. 9 is a partially cut-away detailed view of a leg of the invention table having a cross bar and cross bar retainer attached thereto.
Figure 10A:
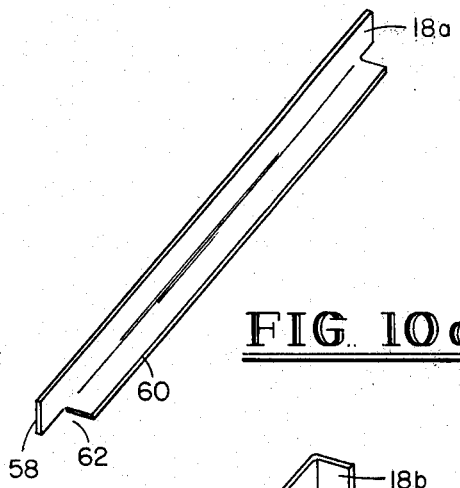
FIGS. 10*a* and 10*b* are perspective views of two versions of the cross bar shown in FIG. 9.
Figure 10B:
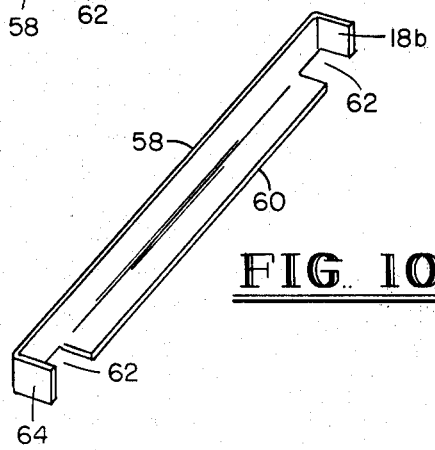

FIGS. 9 and 10 show a detailed partially cut-away view of the leg 16 of the invention having cross bar 18 engaged therewith by means of cross bar retainer 42 and various configurations of the cross bar, respectively. Cross bar 18 slidably mounts on leg 16 behind cross bar retainer lip 43. Cross bar 18*a* having mounting section 58 and support section 60 slides behind cross bar retainer lip 43 of cross bar retainer 42, the end of mounting section 58 fitting flush with the outside of leg 16. The notched area 62 is the same width and depth as leg 16 to provide a precise fit between the cross bar 18 and leg 16. Cross bar 18*b* is very similar to cross bar 18*a* with the exception of cross bar extension 64 which wraps around leg 16. The extension 64 has the same dimensions as leg 16 so as to form a precise fit with the leg 16.

Figure 11:
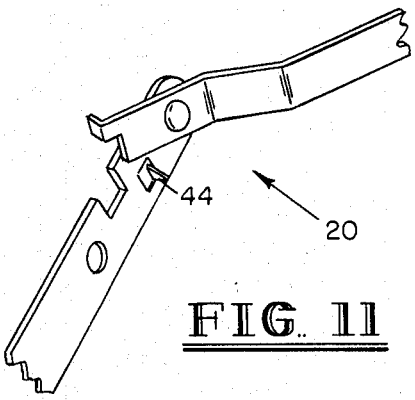
FIG. 11 is a partially cut-away view of a locking support used in the invention table.

FIG. 11 is a partially cut-away view of the locking support used in the invention table. Locking support 20 is of the type well-known in the art, therefore detailed description of the support will not be discussed. Any type of locking support can be used in the invention as long as the support can be folded so as to fit into the receiving channel of the side rail 12 and leg 16. Lock out pin 44 keeps locking support 20 from collapsing involuntarily and thereby causing leg 16 to fold. Lock out pin 44 is easily actuated by pressing with a thumb or finger.

Figure 12:
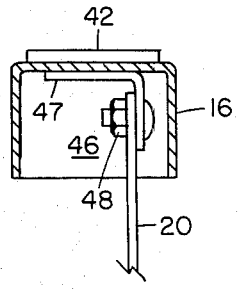
FIG. 12 is a cross-sectional view of a leg of the invention table viewed from above.

FIG. 12 shows a cross-sectional view of a leg 16 of the invention viewed from above looking down onto the interior of the foot 46. An L-connector 47 is attached to the interior of leg 16 by conventional means, such as spot welding or screws. Nut/bolt combination 48 secures locking support 20 to L-connector 47. The opposite end of locking support 20 is connected to side rail 12 (not shown). The receiving area of cross bar retainer 42 is shown secured to the outside of leg 16.

Figure 13:
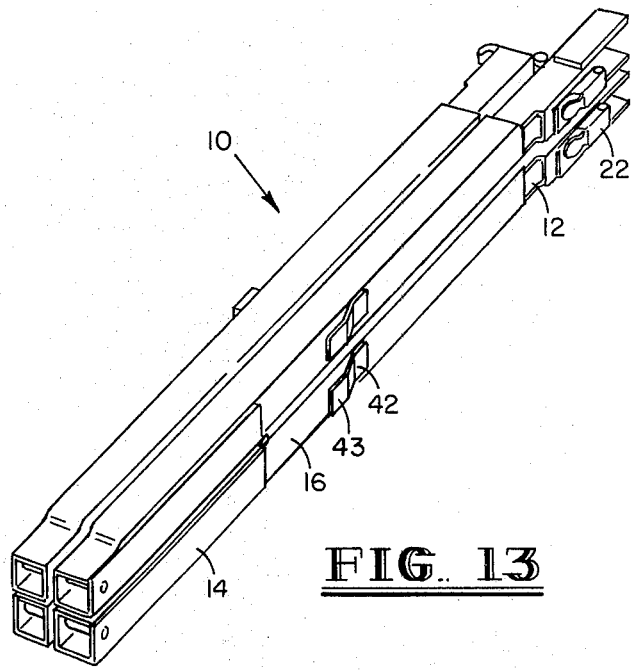
FIG. 13 is a perspective view of the invention table frame folded into a compact unit.

FIG. 13 shows the invention camp table frame 10 folded into a compact unit easily transported and occupying considerably less space than other folding camp tables. Side rail 12 has been folded in half after latch 22 has been disengaged. Leg 16 having cross bar retainer 42 attached has been folded onto side rail 12. Absent cross bars 18 (not shown), end rails 14 pivot on hinges 26 (not shown) and fold over leg 16 already folded onto side rail 12.

METHOD OF OPERATION

Although no right or wrong way exists to assemble and disassemble the invention folding camp table, the following method enables the table to be erected by only one individual.

Taken from its compacted form as shown in FIG. 13 and keeping the side rails 12 folded in half, end rails 14 are unfolded from their compacted position over legs 16 and fully extended to their final operational position. While holding the end rails 14 together firmly in one hand, legs 16 are opened from their compacted position and fully extended until locking support 20 engages. This step is repeated for all four legs. While still firmly holding extended end rails 14 in one hand, cross bars 18 are inserted behind cross bar retainers 42. The legs of the table are then placed on the ground or floor and the middle of the table is picked up by the side rails 12. Loop 35 is placed over buckle hook 38 and buckle 34 is depressed to its locked position. Table frame 10 is now ready to receive table surface 28. With table surface 28 in place, table supports 30 and 32 abut the interior of side rails 12 and support the table frame. The folding camp table is now ready for use. To disassemble the invention table, the procedure outlined above is followed in reverse.

I claim:

1. A folding camp table comprising a foldable frame and a foldable table surface, said frame comprising:

a pair of foldable spaced apart side rails;

a pair of foldable spaced apart end rails, said end rails being perpendicular to and pivotally connected to said side rails to form a rectangle;

legs located normal to each corner of said rectangle, said legs pivotally connected to said side rails, said end rails, side rails and legs having a U-shaped configuration and said end rails and said legs capable of being folded over said side rails to obtain maximum compactibility of said foldable frame and minimal occupation of space by said foldable frame when in the folded state;

foldable locking support means having one end attached to said leg and the opposite end attached to said side rail; and said table surface comprising a flexible material having a series of supports located on the underneath side, said supports distributed the length of said flexible material and extending transversely, the ends of said supports abutting the interior of said side rails of said table frame.

2. The folding camp table of claim 1 wherein fitted between said legs and parallel to said end rails are removable cross bars.

3. The folding camp table of claim 1 wherein said side rails are foldable by means of hinged locking latches located midway on each side rail.

4. The folding camp table of claim 1 wherein said end rails are foldable by means of hinges located midway on each end rail.

5. The folding camp table of claim 2 wherein cross bar retainers attached to said legs retain said removable cross bars.

6. The folding camp table of claim 5 wherein said side rails, said end rails and said legs of said frame are U-shaped aluminum tubing.

7. The folding camp table of claim 1 or 5 wherein said foldable table surface having supports thereon has been molded.

8. The folding camp table of claim 1 or 5 wherein said foldable table surface having supports has been formed by extrusion molding.

9. The folding camp table of claim 1 or 5 wherein said foldable table surface having supports has been formed by injection molding.

10. The folding camp table of claim 1 or 5 wherein said foldable table surface having supports has been molded from plastic.

11. A folding camp table comprising a foldable frame and a foldable table surface, said frame comprising:

a pair of foldable spaced apart side rails, each of said side rails being U-shaped with the open side of said U facing the surface on which said folding table is residing;

a pair of foldable spaced apart end rails, said end rails being perpendicular to and pivotally connected to said rails to form a rectangle, each of said end rails being U-shaped with the open side of said U facing the interior of said rectangle, said end rails capable of being folded over said side rails;

legs located normal to each corner of said rectangle, said legs pivotally connected to said side rails, each of said legs being U-shaped with the open side of said U perpendicular to said open side of said side rails, said legs capable of being folded over said side rails so as to enclose the U-shaped opening of said side rails;

foldable locking support means having one end attached to said legs and the opposite end attached to said side rails; and said table surface comprising a flexible material having a series of supports located on the underneath side, said supports distributed the length of said flexible material and extending transversely, the ends of said supports abutting the interior of said side rails of said table frame.

* * * * *